United States Patent [19]

Chattin

[11] Patent Number: 4,732,133

[45] Date of Patent: Mar. 22, 1988

[54] BOW SLIDER BLOCK

[76] Inventor: Edgar J. Chattin, 10819 Magnolia St., Riverview, Fla. 33569

[21] Appl. No.: 904,633

[22] Filed: Sep. 8, 1986

[51] Int. Cl.[4] ..... F41B 5/00

[52] U.S. Cl. ..... 124/24 R; 124/41 R; 124/88; 124/90

[58] Field of Search ..... 124/23 R, 24 R, DIG. 1, 124/88, 90, 41 R

[56] References Cited

U.S. PATENT DOCUMENTS

| | | | |
|---|---|---|---|
| 2,214,224 | 9/1940 | Douglas | 124/24 R |
| 2,926,650 | 3/1960 | Irwin | 124/24 R |
| 3,021,139 | 2/1962 | Buerosse | 124/41 R |
| 3,572,311 | 3/1971 | Baer | 124/41 R |
| 4,146,009 | 3/1979 | Adams | 124/24 R |
| 4,446,844 | 5/1984 | Nishioka | 124/24 R |

*Primary Examiner*—Randolph A. Reese
*Assistant Examiner*—Peter M. Cuomo
*Attorney, Agent, or Firm*—Frijouf, Rust & Pyle

[57] ABSTRACT

An apparatus is disclosed for propelling a projectile by the use of an archer's bow. An elongate bar means having a first and second end is attached to a handle of the bow in a substantially perpendicular manner relative to the handle of the bow. A slider block with an axial channel formed therein is slidably received along the elongated bar for enabling longitudinal movement along and relative to the bar. An attachment means connects the bowstring to the slider block. A bore formed in the slider block holds the projectile such that in use the slider block is slidably drawn along the bar when the bowstring is moved into drawn position. Upon the release of the bowstring, the force of the bowstring propels the slider block along the bar. The projectile is released from the slider block upon the slider block striking a stop means to enable the projectile to be forcibly and releasably propelled from the bow.

17 Claims, 8 Drawing Figures

BOW SLIDER BLOCK

BACKGROUND OF THE INVENTION

1. Field of the Invention

This invention relates the field of archery and more particularly relates to an apparatus which permits an archery bow to be used for accurately propelling shot, pellets or other like missiles.

2. Information Disclosure Statement

Numerous disclosures teach the use of an archer's bow for propelling shot and the like. U.S. Pat. No. 2,313,803 issued to James E. Carlson teaches a crossbow gun which is loosely defined as a tubular member having a slot through which the bowstring attaches to a ball projector or plunger. Upon drawing the bowstring into a loaded position, the force of the bow is released to the ball plunger which travels within the tube to releasingly propel the projectile. U.S. Pat. No. 1,210,332 teaches an archer's bow which utilizes a bow bending lever and arrow guide and magazine. U.S. Pat. No. 2,214,224 teaches a missile projecting device incorporating a tubular member for creating compressed air upon release of the bowstring to cause the projection of the missile. U.S. Pat. No. 28,698 teaches a crossbow which utilizes a tubular chamber or muzzle for propelling a projectile by the bowstring. U.S. Pat. No. 4,385,618 teaches a projectile shooting guide for an archer's bow where the guide member has a vertical slot opening through the front and terminating short of the rearward end to form a closed end thereat. A casing open at the front to receive projectiles may be used in the guide member. The casing has grooves which give slidable support on the guide member to the casing. The casing further includes an aperture the bowstring. U.S. Pat. No. 4,146,009 is a missile projecting attachment for an archer's bow having a tubular barrel through which a ball or other projectile is propelled by the bowstring. A tubular barrel utilizes two elongated slots which extend along the upper and lower surface of the barrel. A projectile carrier is attached to the bowstring and is guided along the interior surface of the tubular barrel when the bowstring is released from a drawn position. U.S. Pat. No. 3,572,311 teaches a detachable tubular projectile guide means which utilizes a bow with a longitudinally extending slot in the barrel which guides an arm which extends through the slot to an impacting head at the terminal portion of the slot.

The prior art devices utilize a tubular barrel, tracks, or the like, within which a projectile holder is propelled by the bowstring. In order to transfer the energy of the bowstring to the projectile holder, longitudinal slots are cut in the tubular barrel. Accordingly, the bowstring frictionally engages the walls of the slots as the bowstring travels down the barrel extending through the slots. In addition, the projectile holder tends to wobble within the tubular barrel and tends to frictionally engage or bind within the slots as the projectile holder travels down the tubular barrel. The frictional engagements between the projectile holder and the tubular barrel result in an inaccurate device.

It is an object of this invention to provide an apparatus which permits an archery bow to be used for accurately propelling shot, pellets or other missiles.

Another object of this invention to provide an apparatus which provides a single elongate bar means guide member for enhancing the accuracy of a shot, pellet or other missile.

Another object of this invention to provide an apparatus which enables a wobble free and a substantially friction free longitudinal movement relative to an elongate bar means.

Another object of this invention to provide a highly accurate projectile propelling apparatus for use with an archer's bow.

Another object of this invention to provide an apparatus which utilizes a single bar for guiding the projectile holder along the external surface of the single bar to enhance accuracy.

It is a further object of this invention to provide an apparatus utilizing an elongate bar which is slidingly grasped by an inner periphery of a channel extending through the projectile holder to enhance accuracy by providing wobble free travel along the elongate bar.

The foregoing has outlined some of the more pertinent objects of the present invention. These objects should be construed to be merely illustrative of some of the more pertinent features and applications of the invention. Many other beneficial results can be obtained by applying the disclosed invention is a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The apparatus of the present invention is defined by the appended claims with a specific embodiment shown in the attached drawings. For purposes of summarizing the invention, the invention relates to a method and an apparatus for propelling a projectile by the use of a conventional archer's bow, including a crossbow, having an upper limb and a lower limb extending from a handle and an bowstring connecting the limbs. The apparatus comprises an elongate bar means having a first and second end. The first end of the bar means is securably positioned proximate the handle of the bow in a substantially perpendicular manner relative the handle of the bow. A slider block having a first and second end includes an axial channel extending from the first end to the second end of the slider block. The axial channel of the slider block slidably receives the external configuration of the bar means in a tight fitting manner to enable wobble free and substantially friction free longitudinal movement along the bar means. An attachment means connects the bowstring to the slider block to enable simultaneous movement therewith. A bore formed in the slider block and disposed at the first end of the slider block adjacent to the axial channel holds the projectile within the bore. A stop means is positioned proximate the handle for stopping the slider block upon impact with the stop means. The slider block may be slidably drawn longitudinally along the bar means when the bowstring is positioned in a drawn position. Upon release of the bowstring, the force of the bow is transferred to the bowstring to propel the slider block along the bar means. The projectile is released upon striking the stop means to enable the projectile to be forcibly and releasably propelled from the tubular bore.

A further embodiment the apparatus of the invention includes a bar means which is releasably secured proximate the handle of the archer's bow. The bar means enables the apparatus of the invention to be removed from the bow to enable the bow to be used to propel arrows or whenever removal is desired.

Another embodiment the apparatus of the invention includes a slider block which is formed of a self-lubricating material. The self-lubricating material enables substantially frictionless movement by the block along the bar means. The self-lubricating materials include nylon, DACRON, TEFLON (tetrafluoroethylene resin) and graphite-containing plastic materials. The preferred composition forming the slider block is tetrafluoroethylene resin.

In a preferred embodiment of the apparatus of the invention, the elongate bar means is substantially perpendicular to the handle and the attachment means includes a bowstring passage formed in the slider block to grippingly receive the bowstring to enable the block to be securely attached to the bowstring.

In another embodiment of the invention, the stop means includes a resilient tubular shaped member having a first and second end with an internal passageway extending therebetween. The first end of the resilient tubular shaped member is positioned proximate the handle. The resilient tubular shaped member is frictionally received on the bar means such that the slider block collides with the second end of the resilient member to enable the projectile to be propelled from the bore cavity. It is preferred that the stop means be resilient, such as rubber.

In a preferred embodiment of the invention, the bar means is an elongate cylindrical shaped bar with a circular cross section. Preferably, the slider block includes an axial channel having a circular configuration formed in the slider block to enable the slider block to be slidably received about the circumference of the bar means in a tight fitting manner to enable a wobble and binding free longitudinal movement along the bar means.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
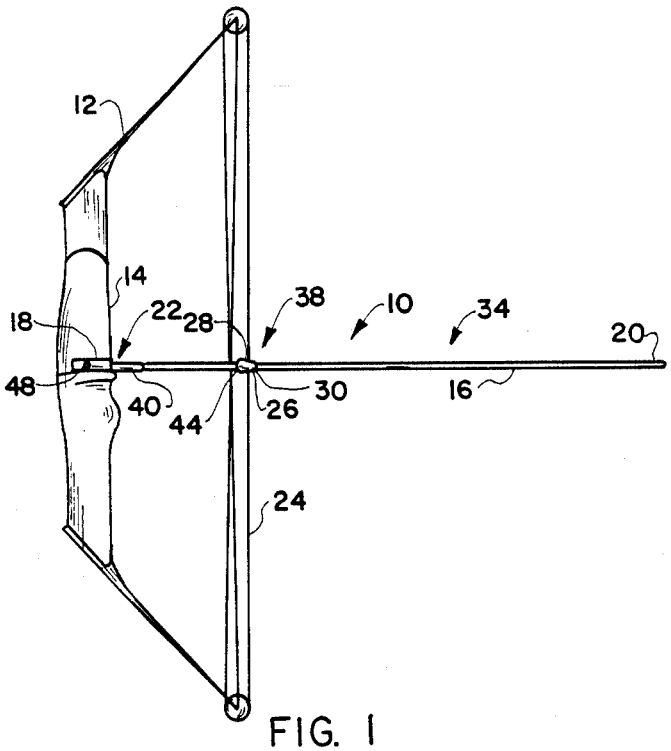
FIG. 1 is a side view illustrating the apparatus of the invention attached to an archer's bow in a rest position.

FIG. 1 is a side view illustrating the apparatus of the invention 10 attached to an archer's bow 12 proximate the handle 14. The elongate bar 16 includes a first end 18 and second end 20. The first end 18 of elongate bar means 16 is attached proximate the handle of the bow 14 in a substantially perpendicular manner 22 relative the handle of the bow 14. A slider block 26 having a first end 28 and a second end 30 includes an axial channel 32 (not shown) formed in the slider block 26. The axial channel 32 extends from the first end 28 to the second end 30 of the slider block 26. This configuration enables the slider block 26 to be telescopically slidably received about the external configuration 34 of the elongate bar means 16 in a circumferentially tight fitting manner to enable a wobble free and a binding free longitudinal movement along the bar means 16. An attachment means 38 connects the bowstring 24 to the slider block 26. A bore 36 (not shown) formed in the slider block 26 and disposed at the first end 28 of the slider block 26 adjacent to the axial channel 32 for holding the projectile. A stop means 40 for stopping the slider block 26 whereby in use the slider block 26 is slidably drawn along the bar means 16 when the bowstring 24 is positioned in a drawn position 42. Upon release of the bowstring 24, the force of the bow is transferred to the bowstring which propels the slider block 26 along the bar means 16 and upon striking the stop means 40 the projectile 44 is releasable and forcibly propelled from the bore 36 of slider block 26.

Figure 2:
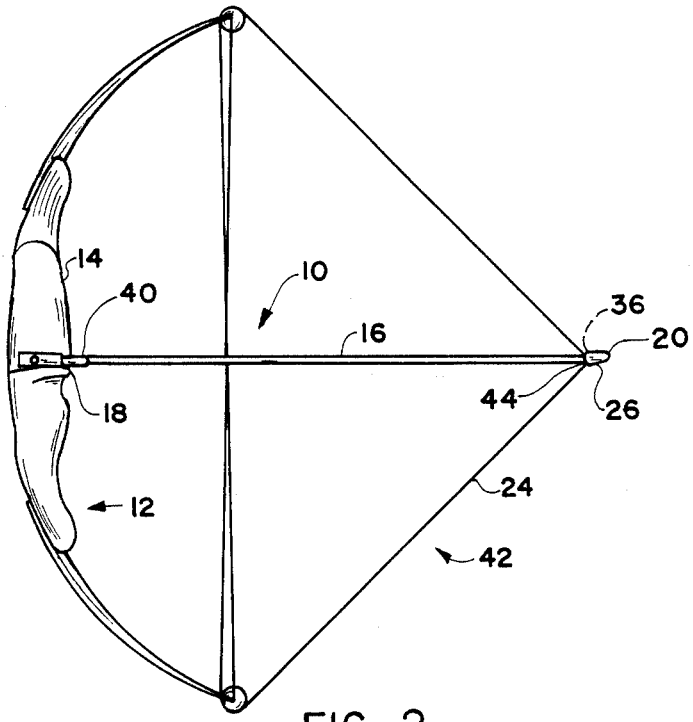
FIG. 2 is a side view illustrating the apparatus of the invention attached to an archer's bow in a drawn position.

FIG. 2 is a side view illustrating the apparatus of the invention 10 attached to an archer's bow 12 in a drawn position 42. The bowstring 24 is attached to slider block 26 with projectile 44 releasably positioned in bore 36. The slider block 26 is positioned proximate the second end 20 of elongate bar 16 prior to the archer releasing the bowstring 24 in order to propel the slider block 26 and projectile 44 toward the stop means 40. Upon releasing bowstring 24, slider block 26 is propelled along elongate bar 16 toward stop means 40.

Figure 3:
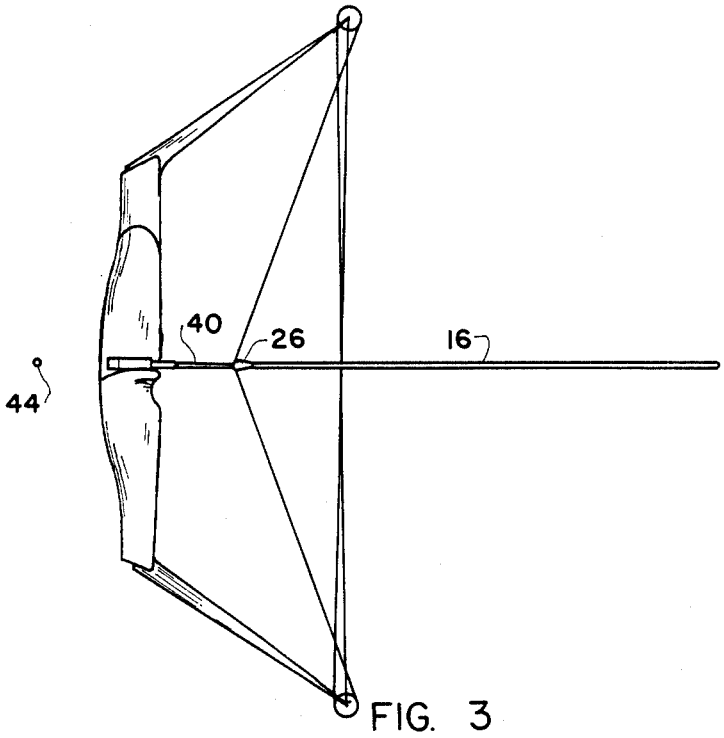
FIG. 3 is a side view illustrating the apparatus of the invention attached to an archer's bow with a projectile being projected from the apparatus.

FIG. 3 is a side view illustrating the apparatus of the invention 10 attached to an archer's bow 12 with a projectile 44 being propelled from the slider block 26 after striking the stop means 40.

Figure 4:
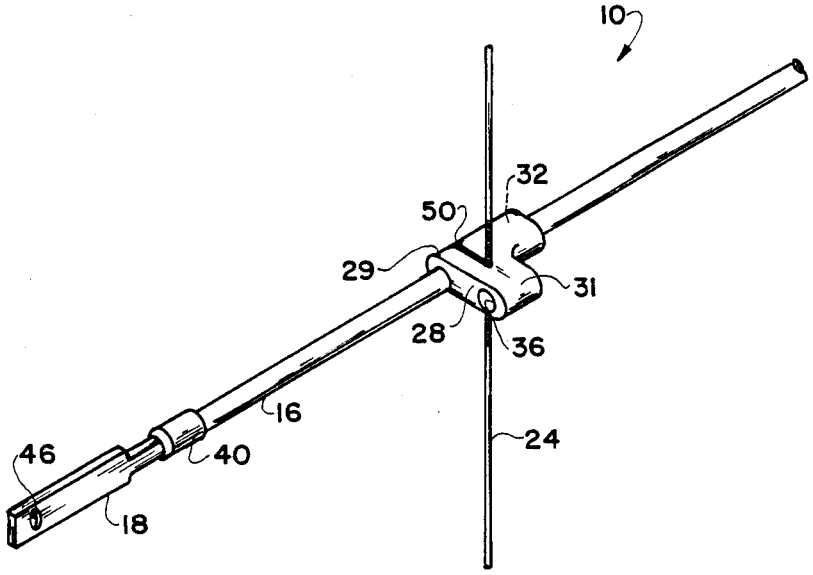
FIG. 4 is an enlarged view of a portion of the apparatus of the invention attached to a bowstring.

FIG. 4 is an enlarged view of the apparatus of the invention 10 attached to a bowstring 24. The first end 18 of the elongate bar 16 is provided with a countersunk mount hole 46 through which a screw threaded bolt 48, (not shown) or the like, engages the handle 14 (not shown). Preferably, the first end 18 of the elongate bar 16 of the invention is attached to the handle 14 by one screw threaded bolt 48, or the like. This enables the elongate bar 16 to pivot about the screw threaded bolt 48 in the event the user of the bow draws the bowstring in an off-center manner. The stop means 40 is positioned proximate the handle 14 in order to provide the greatest travel distance along the elongate bar 16 by the slider block 26. The bowstring passage 50 enables the bowstring 24 to traverse the slider block 26. The placement of the bowstring passage 50 at FIG. 4 illustrates the preferred placement of the passage 50 with the elongate bar 16 being positioned to prevent the inadvertent release of the bowstring 24 while in use. The projectile bore 36 in the slider block 26 provides a cavity into which the projectile is positioned.

Figure 5:
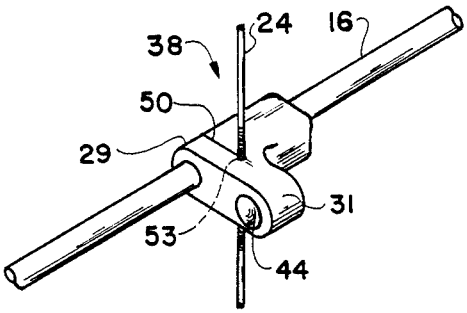
FIG. 5 is a partial view of the slider block of FIG. 4 with a pellet positioned therein.

FIG. 5 is a view of the slider block 26 of FIG. 4 with a slug or pellet 44 positioned in the bore 36. Where the projectile is a single object such as a pellet or slug, preferably of a rounded shape, the projectile frictionally fits into the bore 36 of the slider block. This enables the bow to be angularly disposed in any position without inadvertent loss of the projectile.

The slider block 26 may further include a third end 29 and a fourth end 31 wherein the attachment means 38 includes a bowstring passage 50 formed in the slider block 26. Bowstring passage 50 extends form the third end 29 of the slider block 26 through the axial channel 32 and to a position 53 within the slider block 26 to enable the elongate bar means 16 to provide a barrier for preventing inadvertent destringing of the bowstring 24 from the slider block 26.

Figure 6:
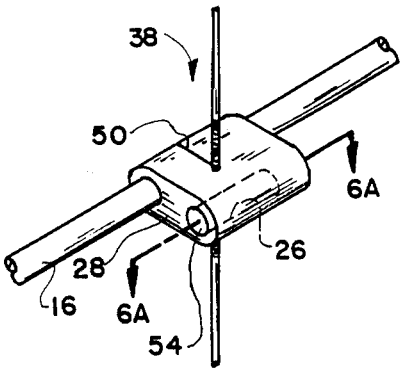
FIGS. 6 and 6A are views of a slider block with shot positioned therein.
Figure 6A:
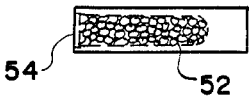

FIG. 6 is a view of another embodiment of the slider block 26 of FIG. 4 with a plurality of shot 52 positioned in the bore 36. Since the projectiles are small relative the single slug, a cardboard wad 54, or the like, is frictionally fit into the bore 36 to prevent the projectiles from inadvertent loss, as best illustrated by partial sectional view of FIG. 6A.

Figure 7:
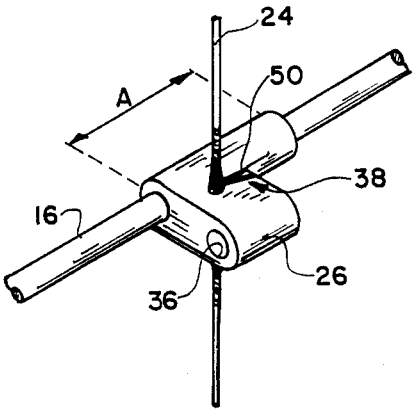
FIG. 7 is a partial view illustrating an attachment means.

FIG. 7 is a view illustrating another embodiment of the attachment means 38. In this embodiment, the bowstring 24 frictionally fits into the second side 30 of the slider block 26. Preferred in each embodiment of slider block 26 is a distance "A" which is sufficient to further enhance a wobble free and a binding free longitudinal movement along the elongated bar means as the slider block 26 slidably travels along the elongated bar means. Generally, a distance of "A" of about 1-1½ inches is sufficient.

The attachment means preferably includes bowstring passage 50. Other attachment means such as a clip secured to the slider block which grasps the bowstring 24 is within the scope of the invention.

In operation the bowstring is positioned within the bowstring passage 50 of the slider block 26. The first end 28 of the slider block 26 is slidably positioned on the elongate bar 16 to further secure the bowstring 24 within the bowstring passage 50, as see FIG. 4. The first end 10 of the elongate bar means 16 is securely attached proximate the bow handle 14. The slider block 26 is now slidably positioned on the external configuration of the elongate bar 34 such that the axial channel 32 formed in the slider block 26 extends through each end of the slider block providing a passageway for the elongate bar 16. The slider block 26 slidably mounts the elongate bar 16 in a tight fitting manner to provide wobble free and substantially friction free longitudinal movement along the elongate bar 16. The slidably tight relationship between the surface of the elongate bar 16 in contact with axial channel 32 of the slider block 26 enhances accuracy of the apparatus. The elongate bar means 16 guides the slider block 26 to the stop means 40 to further enhance accuracy and to obtain full advantage of the distance between the fully drawn position and the stop means. The attachment means 38 for connecting the bowstring 24 to the slider block 26 preferably includes a bowstring passage 50 to grippingly receive the bowstring 24 therethrough. The bowstring passage 50 enables the slider block 26 to be securely attached to the bowstring 24. The bore 36 formed in the slider block 26 and disposed at the first end 28 of the slider block 26 adjacent to the axial channel 32 holds the projectile 44 or projectiles 52. A stop means 40 for stop the slider block 26 whereby in use the slider block 26 is slidably drawn along the bar means 16 when the bowstring 24 is positioned in a drawn position 42 and upon release of the bowstring 24, the force of the bow transferred to the bowstring propels the slider block 26 along the bar means 16 and releasing the projectile upon striking the stop means 40 to enable the projectile 44 or 52 to be forcibly and releasably propelled from the bore 36.

In another operation the first end 18 of the elongate bar 16 is securely attached proximate the handle of the bow 14 in a substantially perpendicular manner 22 relative the handle of the bow 14. The first end 28 of the slider block 26 is positioned on the elongate bar 16 such that the axial channel 32 formed in the slider block 26 which extends through each end of the slider block to provide a passageway for the elongate bar 16 is slidably positioned on the external configuration of the elongate bar 34. The slider block 26 slidably mounts the elongate bar in a tight fitting manner to provide wobble free and substantially friction free longitudinal movement along the elongate bar. The slidably tight relationship between the surface of the elongate bar and the axial channel of the slider block enhance accuracy of the apparatus. The elongate bar means guides the slider block to the stop means to further enhance accuracy and to obtain full advantage of the distance between the fully drawn position and the stop means. The attachment means 38 for connecting the bowstring 24 to the slider block 26 preferably includes a bowstring passage 50 to grippingly receive the bowstring 24 therethrough and is parallel to channel 32 is illustrated at FIG. 7. The bowstring passage enables the slider block to be securely attached to the bowstring. This embodiment enables the elongate bar to be first attached to the bow, then placing the slider block on the bar and attaching the bowstring to the slider block.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An apparatus for propelling a projectile by the use of an archer's bow including a handle and a bowstring comprising:

an elongate bar means having an external configuration and a first and a second end;

said first end of said elongate bar means being securely positioned proximate the handle of the bow;

a slider block having a first and a second end;

an axial channel formed in said slider block and extending from said first end to said second end of said slider block to enable said slider block to be slidably received about said external configuration of said bar means in a tight fitting manner to enable wobble free and substantially friction free longitudinal movement along said bar means;

an attachment means for connecting the bowstring to said slider block;

said attachment means being positioned apart from said axial channel formed in said slider block;

a bore formed in said slider block and disposed at said first end of said slider block adjacent to said axial channel for holding the projectile;

a stop means for stopping said slider block;

said slider block being slidably moved along said elongate bar means proximate said second end of said elongate bar means when the bowstring is positioned in a drawn position and upon release of the bowstring, the force of the bow is transferred to the bowstring and said slider block to propel said slider block along said elongate bar means; and said stop means releasing the projectile upon said slider block striking said stop means to enable the projectile to be releasably and forcibly propelled from said bore.

2. The apparatus of claim 1 wherein said elongate bar means is releasably attached to the handle of the archer's bow.

3. The apparatus of claim 1 wherein said external configuration of said elongate bar means is cylindrical.

4. The apparatus of claim 1 wherein said first end of said bar means is securely positioned proximate the handle of the bow in a substantially perpendicular manner relative the handle of the bow.

5. The apparatus of claim 1 wherein said slider block is formed of a self-lubricating material.

6. The apparatus of claim 5 wherein said slider block is formed of tetrafluoroethylene.

7. The apparatus of claim 5 wherein said slider block is formed of nylon.

8. The apparatus of claim 1 wherein said slider block further includes a third end and a fourth end.

9. The apparatus of claim 8 wherein said attachment means includes a bowstring passage formed in said slider block wherein said bowstring passage extends form said third end of said slider block through said axial channel and to a position within said slider block to enable said elongate bar means to prevent the inadvertent destringing of said slider block.

10. The apparatus of claim 1 wherein said attachment means includes a bowstring passage formed in said slider block to grippingly receive the bowstring therethrough to enable said slider block to be securely attached to the bowstring.

11. The apparatus of claim 1 wherein said stop means includes a resilient tubular shaped member having an aperture formed therein to enable said resilient tubular shaped member to be frictionally received on said elongate bar means.

12. The apparatus of claim 1 wherein said stop means is positioned in use proximate the handle of the archer's bow.

13. An apparatus for propelling a projectile by the use of an archer's bow including a handle and a bowstring comprising:

an elongate cylindrically shaped bar with a circular cross section having a first and a second end;

said first end of said elongate bar being releasably secured and positioned proximate the handle of the archer's bow in a substantially perpendicular manner relative the handle of the bow;

a slider block having a first and a second end;

an axial channel formed in said slider block and extending from said first end to said second end of said slider block to enable said slider block to be slidably received about said elongate cylindrically shaped bar in a tight fitting manner to enable wobble free and substantially friction free longitudinal movement along said elongate bar;

said slider block further including a third end and a fourth end;

an attachment means for connecting the bowstring to said slider block being positioned apart from said axial channel formed in said slider block;

said attachment means includes a bowstring passage formed in said slider block wherein said bowstring passage extends form said third end of said slider block through said axial channel and to a position within said slider block to enable said elongate bar means to prevent the inadvertent destringing of said slider block;

a bore formed in said slider block and disposed at said first end of said slider block adjacent to said axial channel for holding the projectile;

a stop means for stopping said slider block positioned in use proximate the handle of the archer's bow;

said slider block being slidably drawn along said bar means when the bowstring is positioned in a drawn position and upon release of the bowstring, the force of the bow transferred to the bowstring propels said slider block along said bar means; and said stop means includes a resilient tubular shaped member having an aperture formed therein to enable said resilient tubular shaped member to be telescopically frictionally received on said bar means whereby in use said slider block is slidably drawn along said bar means when the bowstring is positioned in a drawn position and upon release of the bowstring, the force of the bow transferred to the bowstring propels said slider block along said bar means and releases the projectile upon striking said stop means to enable the projectile to be releasably and forcibly propelled from said bore.

14. The apparatus of claim 13 wherein said slider block is formed of a self-lubricating material.

15. The apparatus of claim 14 wherein said slider block is formed of tetrafluoroethylene resin.

16. The apparatus of claim 14 wherein said slider block is formed of nylon.

17. The apparatus of claim 13 wherein said attachment means includes a bowstring passage formed in said slider block to grippingly receive the bowstring therethrough to enable the block to be securely attached to the bowstring.

* * * * *